United States Patent [19]

Fletcher et al.

[11] Patent Number: 4,533,230

[45] Date of Patent: Aug. 6, 1985

[54] PIN CHARGING DEVICE FOR USE IN XEROGRAPHY

[75] Inventors: Gerald M. Fletcher, Pittsford; Robert M. Jacobs, Rochester; Kenneth W. Pietrowski, Pittsford, all of N.Y.

[73] Assignee: Xerox Corporation, Stamford, Conn.

[21] Appl. No.: 461,074

[22] Filed: Jan. 26, 1983

[51] Int. Cl.[3] ..... G03G 15/02

[52] U.S. Cl. ..... 355/3 CH; 250/324; 355/14 CH

[58] Field of Search ..... 355/3 CH, 3 R, 14 CH; 250/324, 325

[56] References Cited

U.S. PATENT DOCUMENTS

| | | | |
|---|---|---|---|
| 3,244,083 | 4/1966 | Gundlach | 355/3 CH |
| 3,254,215 | 5/1966 | Oliphant | 355/3 CH X |
| 3,374,348 | 3/1968 | Ostensen | 355/3 CH X |
| 3,658,407 | 4/1972 | Kitano et al. | 350/96 B |
| 3,947,106 | 3/1976 | Hamaguchi et al. | 355/1 |
| 3,977,777 | 8/1976 | Tanaka et al. | 355/1 |
| 4,136,942 | 1/1979 | Nakahata et al. | 355/3 CH |
| 4,372,669 | 2/1983 | Fantuzzo et al. | 355/3 CH X |

*Primary Examiner*—Fred L. Braun

[57] ABSTRACT

A discharge apparatus for use in applying a uniform electrostatic charge to a charge retentive surface. Specifically, the apparatus has an array of pin or needle electrodes for negatively charging the surface. The electrodes are coupled to a pulsed d.c. power supply designed to cause them to operate at sufficiently high current densities to insure stable output therefrom yet due to the pulsing stability is achieved at relatively low current levels. Thus, operation at higher current densities for shorter intervals, for example, at half duty achieves output stability at lower current levels.

3 Claims, 4 Drawing Figures

PIN CHARGING DEVICE FOR USE IN XEROGRAPHY

BACKGROUND OF THE INVENTION

This invention relates to electrostatic discharge devices adapted for use in applying a uniform electrostatic charge to a charge retentive surface and in particular to a device which uses pin or needle electrodes for negatively charging the surface.

The most common discharge devices used for uniformly charging a charge retentive surface either negatively or positively are of two types. One type utilizes one or more bare wires positioned parallel to the surface to be charged and the other type utilizes an array of pin or needle electrodes which are supported such that the axes thereof are substantially perpendicular to the surface. The bare wire type of device is more commonly employed than pin or needle electrodes. However, a bare wire is usually less suitable for negative charging because of charging non-uniformities and it generates larger amounts of ozone.

The provision of multiple wires minimizes the non-uniformity problem but creates space problems and increases the cost of the device. The non-uniform charging with bare wire devices has been minimized by continuously applying higher voltages to a single wire to produce higher current densities flowing from the wire but this creates even greater amounts of ozone because of the higher currents. Significant amounts of ozone are objectionable for various reasons. One of the more important objections is its adverse effects on photoconductive surfaces used in xerography. Since the charging devices are very close to the surface it is difficult if not impossible to keep ozone away from the surface.

Certain features of the pin device are self-evident: it is rigid, nonbreakable, and not subject to vibrations. This leads to advantages in field maintenance. For example, the potential for photoreceptor damage due to broken corotron wires is eliminated and the potential for electrical accidents from a dangling high voltage wire does not exist. Moreover, from the standpoint of ozone generation, pin or needle electrodes are preferred since they generate substantially less ozone. First attempts at utilizing pin electrodes for uniformly charging a charge retentive surface such as a photorecetor or plate negatively revealed that while they produce much less ozone than wire devices they did not provide the desired uniformity of charging.

The corona output from a needle-like array configuration can be especially non-uniform and very time dependently unstable at low operating in currents, especially when operating in the negative d.c. mode. For low plate current applications, this has required device designs which produce high shield currents in order to achieve reasonable uniformity with a practical device. Since ozone generation rate is well known to be proportional to the total output current such devices not only are inefficient but the ozone output thereform is substantially increased. Some reduction of the required inefficiency has been achieved by choosing various small radiused (less than 0.025 millimeter) needles for negative charging applications. However, even with sharp needles, it is still necessary to provide about 4 microamps per needle in a practical device in order to achieve reliable output stability and uniformity even though the required plate current is low.

In many perferred design configurations, it is desirable to increase the number of pins per area to be charged, and this decreases the current per pin at any given required operating device plate current. This results in even further decrease in efficiency being required in order to achieve stable output from the device. In other words, if the number of pins were doubled for a given plate current requirement then the current per pin would be half of what it was initially, i.e. with only half the pins. Assuming that the current per pin with the original number of pins was just adequate to produce stable outputs therefrom then the total current would have to be doubled in order to maintain stable output current from each pin. For this situation, more current would be drawn by the conductive shield. Thus, more ozone would be generated because more current is needed and the device would be less efficient because a larger portion of the total current to the pins flows to the shield for the new set of conditions.

It should now be apparent that an acceptable pin charging device must supply the required plate current and the current to each pin must be sufficient to produce stable outputs from the pins. Heretofore, in providing sufficient pin current to insure stable output therefrom large amounts of current were provided thus producing unacceptable ozone levels and a wasting of energy. One example of this is, as mentioned hereinabove, where the number of pins are increased for a given plate current requirement. Another example is where a higher current value is supplied to each pin for a particular pin design (i.e. a specific tip radius) than is required for stable output therefrom in order to compensate for manufacturing tolerances. Since it is quite difficult for every pin of an array to have exactly the same radius when manufactured it is desirable to provide current in excess of that required for the pin tip radius as per the design. In this way if one or more pins of the array have a slightly larger radius thereby requiring more current than the smaller radiused pin for stable output then the current needs for the larger radiused pin will be met. Even if the pin array could be manufactured so that each and every pin tip had exactly the same radius we have found that the tip geometry (i.e. tip radius) changes due to wear, chemical growth and toner contamination can be partially compensated for by supplying excess (i.e. more current than needed for stable output) current to each pin. However, as will be appreciated, when this is done using conventional power supply techniques, ozone generation is higher and the device is less efficient.

SUMMARY OF THE INVENTION

Briefly, in accordance with the present invention, we have devised a method and apparatus allowing greater latitude in the design (i.e. total number of pins) of an array of pins for charging a charge retentive surface or plate. Our method and apparatus also allows for compensation for variations of the manufacturing tolerance of the pin tip radius and compensation for pin tip geometry changes due to wear, chemical growth and toner contamination without generating excessive ozone amounts or producing a device that is excessively inefficient. To this end, we have provided a pin charging array wherein the pins are operatively coupled to a square or sine wave pulsed (50% duty cycle) power supply. With a 50% duty cycle with sine wave pulsing, the average current is approximately half the peak current to the pins. By selecting a value for the average current that provides the required plate current but yet provides peak current per pin that ensures stable current output we have provided a pin charging device that yelds a stable output while minimizing tradeoffs, such as ozone generation and inefficiency. From the standpoint of applied voltage considerations, the square wave pulsing is preferred since the pin current can be obtained with a lower applied voltage.

DETAILED DESCRIPTION OF THE PREFERRED EMBODIMENT

While the present invention will hereinafter be described in conjunction with the preferred embodiments thereof, it will be understood that it is not intended to limit the invention to that embodiment. On the contrary, it is intended to cover all alternatives, modifications and equivalents as may be included within the spirit and scope of the invention as defined by the appended claims.

Figure 1:
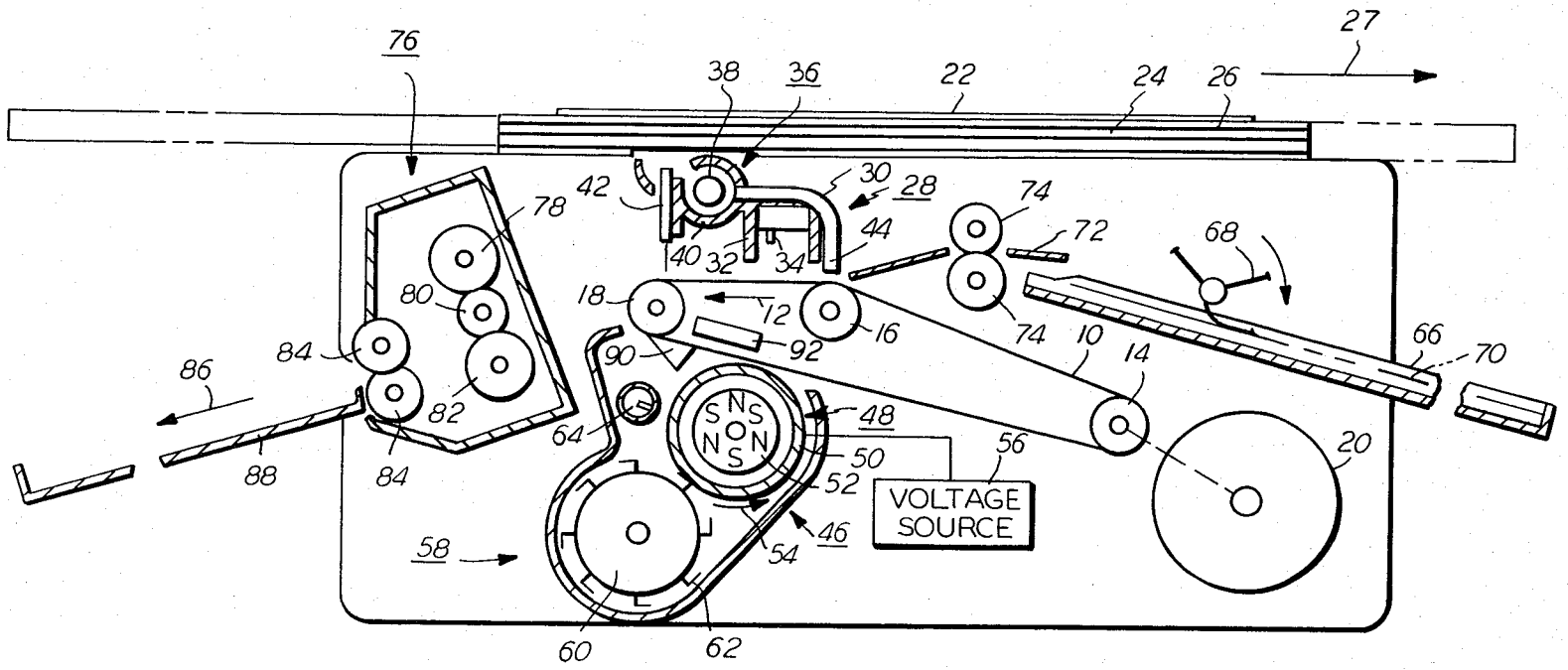
FIG. 1 is a schematic elevational view of an electrographic printing machine incorporating a pin array for charging a charge retentive surface.

For a general understanding of the features of the present invention, reference is had to the drawings. In the drawings, like reference numerals have been used throughout to designate identical elements. FIG. 1 schematically depicts the various components of an electrophotographic printing machine incorporating the features of the present invention therein. It will become evident from the following discussion that these features are equally well suited for use in a wide variety of electrostatographic printing machines, and are not necessarily limited in their application to the particular embodiment depicted herein.

As shown in FIG. 1 of the drawings, the electrophotographic printing machine employs a belt suitable for being negatively charged comprising a photoconductive surface and a conductive substrate of conventional design. Belt 10 moves in the direction of arrow 12 to advance successive portions of the photoconductive surface through the various processing stations disposed adjacent the path of movement thereof. Rollers 14, 16 and 18 maintain belt 10 under suitable tension. Roller 14 is coupled to drive motor 20. Rollers 16 and 18 are mounted in suitable bearings to rotate freely and act as idler rollers. Motor 20 drives roller 14 to advance belt 10 in the direction of arrow 12.

An original document 22 is disposed facedown upon a transparent platen 24. Platen 24 is mounted in a frame 26 which is capable of reciprocating motion in a horizontal plane as indicated by arrow 27. Belt 10 is driven at a linear velocity substantially equal to the linear velocity of platen 24. Belt 10 moves in a recirculating path. In order to reproduce a copy of an original document, belt 10 performs two complete cycles of movement through the recirculating path.

During the first cycle, belt 10 advances a portion of the photo-conductive surface initially beneath a charging-transferring unit, indicated generally by the reference numeral 28. Charging-transferring unit 28 includes a corona generating device 30 which charges the photoconductive surface of belt 20 to a relatively high substantially uniform potential. Corona generating device 30 includes a U-shaped shield 32 having an open end facing the photoconductive surface of belt 10. One row of substantially equally spaced pins 34 are supported such that they extend outwardly from shield 32 toward the open end thereof.

Next, the charged portion of photoconductive surface 12 is advanced beneath a combined exposing-discharging unit, indicated generally by the reference numeral 36. Combined exposing-discharging unit 36 includes a light source 38, preferably an elongated tungsten lamp. Light source 38 is disposed stationarily beneath platen 24. An opaque shield 40 surrounds light source 38. Shield 40 has a slit therein so that the light rays from light source 38 are projected onto original document 22 disposed facedown on transparent platen 24. As platen 24 moves to the left as viewed in FIG. 1, successive incremental portions of original document 22 are illuminated. Light rays reflected from original document 22 are transmitted through a bundle of image transmitting fibers, indicated generally by the reference numeral 42. Image transmitting fibers 42 are bundled gradient index optical fibers. U.S. Pat. No. 3,658,407 issued to Kitano et al in 1972 describes a light conducting fiber made of glass or synthetic resin which has a refractive index distribution in cross section thereof that varies consecutively and parabolically outwardly from a center portion thereof. Each fiber acts as a focusing lens to transmit part of an image placed at, or near, one end thereof. An assembly of fibers, in staggered two-row array, transmits and focuses a complete image of the object. The fiber lenses are produced under the trade name "SELFOC;" the mark is registered in Japan and owned by Nippon Sheet Glass Company, Limited. These gradient index lens arrays are used as a replacement for conventional optical systems in electrophotographic printing machines, such use being disclosed in U.S. Pat. No. 3,947,106 issued to Hamaguchi et al in 1976 and U.S. Pat. No. 3,977,777 issued to Tanaka et al in 1976. The relevant portions of the foregoing patents are hereby incorporated into the present disclosure. The light rays reflected from the original document form a light image which are transmitted through the image transmitting fibers onto the charged portions of the photoconductive surface of belt 10 to dissipate the charge thereon in accordance with the pattern of the light image. This records an electrostatic latent image on the photoconductive surface of belt 10 which corresponds to the informational areas contained within original document 22. Combined exposing-discharging unit 36 also includes a light transmitting glass fiber optical tube 44. One end of optical tube 44 is disposed closely adjacent to light source 38. The other end of optical tube 44 is positioned closely adjacent to the photoconductive surface of belt 10 prior to combined charging-transferring unit 28 in the direction of movement of belt 10, as indicated by arrow 12.

Thereafter, belt 10 advances the electrostatic latent image recorded on the photoconductive surface to a combined developing-cleaning unit, indicated generally by the reference numeral 46. Combined developing-cleaning unit 46 includes a developer roller, indicated generally by the reference numeral 48. Developer roller 48 comprises an elongated cylindrical magnet 52 mounted interiorly of tubular member 50. Tubular member 50 rotates in the direction of arrow 54. Voltage source 56 is electrically connected to tubular member 50 so as to electrically bias tubular member 50 to a potential ranging from about 50 volts to about 500 volts. A specific selected voltage level depends upon the potential level of the latent image and that of the background area. During development, the biasing voltage is intermediate that of the background and latent image. Conveyor 58 which comprises a cylindrical member 60 having a plurality of buckets 62 thereon advances developer material comprising magnetic carrier granules having toner particles adhering triboelectrically thereto upwardly to developer roller 48. Developer roller 48 attracts the developer material thereto. As tubular member 50 rotates in the direction of arrow 54. The developer material is transported into contact with the latent image and toner particles are attracted from the carrier granules thereto. In this way, a toner powder image is formed on the photoconductive surface of belt 10. Auger 64 mixes the toner particles with the carrier granules. Preferably, tubular member 50 is made from a non-magnetic material such as aluminum having the exterior circumferential surface thereof roughened. Magnetic member 52 is made preferably from barrium ferrite having a plurality of magnetic poles impressed thereon. A metering blade, not shown, may be emloyed to define a gap between tubular member 50 through which the developer material passes. This gap regulates the quantity of developer material being transported into contact with the electrostatic latent image recorded on the photoconductive surface of belt 10.

After the toner powder image is formed on the photoconductive surface of belt 10, it returns the toner powder image to the combined charging-transferring unit 28 for the start of the second cycle. At this time, a copy sheet 66 is advanced by sheet feeder 68 to combined charging-transferring unit 28. The copy sheet is advanced in a timed sequence so as to be in synchronism with the toner powder image formed on the photoconductive surface of belt 10. In this way, one side of the copy sheet contacts the toner powder image formed on the photoconductive surface of belt 10. In this way, one side of the copy sheet contacts the toner powder image at combined charging-transferring unit 28. Preferably, sheet feeder 68 includes a rotatably mounted cylinder having a plurality of spaced, flexible vanes extending outwardly therefrom. The free end of each vane successively engages the uppermost sheet 66 of stack 70. As feeder 68 rotates, sheet 66 moves into chute 72. Registration roller 74 advances sheet 66, in synchronism with the toner powder image on the photoconductive surface of belt 10, to combined charging-transferring unit 28.

Corona generating device 30 of combined charging-transferring unit 28 sprays ions onto the backside of the copy sheet. This attracts the toner powder image from the photoconductive surface of belt 10 to the sheet. After transfer, the sheet continues to move with belt 10 until the beam strength thereof causes it to strip therefrom as belt 10 passes around roller 18. As the sheet separates from belt 10, it advances to a fuser assembly, indicated generally by the reference numeral 76. Preferably, fuser assembly 76 includes a backup rollr 78, a pressure roller 80 and a fuser roller 82. The sheet passes between rollers 80 and 82, the toner images contacting the fuser roller 82 whereby pressure is applied to permanently affix the toner powder images to the copy sheet. Thereafter, exiting rollers 84 advance the sheet in the direction of arrow 86 onto catch tray 88 for subsequent removal from the printing machine by the operator.

As belt 10 advances the residual toner particles adhering to the photoconductive surface to combined developing-cleaning unit 46, a toner particle disturber 90 smears the residual particles adhering to the photoconductive surface thereby facilitating removal thereof by the unit 46. Toner particle disturber 90 includes an elastomeric or foam member extending across the width of belt 10. During the first cycle, the elastomeric member is spaced from the photoconductive surface of belt 10. During the second cycle, a motor driven cam moves the elastomeric member into contact with the photoconductive surface so as to smear the residual toner particles prior to the removal thereof from the photoconductive surface. In view of a motor driven cam, one skilled in the art will appreciate that a solenoid may be employed to move the elastomeric member of the toner particle disturber 90 into and out of contact with the photoconductive surface of belt 10. After the residual toner particles have been smeared, the photoconductive surface of belt 10 is illuminated by an electroluminescent strip 92 is positioned between tubular member 50 and toner particle disturber 90. This further reduces the charge attracting residual toner particles to the photoconductive surface of belt 10. Thereafter, combined developing-cleaning unit 46 removes the residual toner particles from the photoconductive surface of belt 10. During the second cycle, voltage source 56 electrically biases tubular member 50 to a potential greater than that of the latent image. Thus, during cleaning, voltage source 56 electrically biases tubular member 50 to a potential having a magnitude greater than the developing potential of the first cycle. In this way, the toner particles are attracted to the carrier granules adhering to tubular member 50. Thus, the residual toner particles are removed from the photoconductive surface and returned to the combined developing-cleaning unit for subsequent reuse.

After the residual toner particles have been cleaned from the photoconductive surface of belt 10, the residual charge thereon passes beneath combined exposing-discharging unit 36. At this time, a light shutter (not shown) permits light rays from light source 38 to be transmitted through fiber optic tube 44 onto the photoconductive surface. These light rays illuminate the photoconductive surface to remove any residual electrostatic charge remaining thereon prior to the charging thereof for the next successive cycle. During the first cycle, the shutter prevents light rays from light source 36 from being transmitted through tube 44.

The charging-transferring unit as noted hereinbefore comprises a single row or linear array of pins 34. The pin tip radius or diameter dictates the current requirement for stable current output densities which will produce uniform charging of a charge-retentive surface such as a photoreceptor plate. The smaller the pin tip radius, the smaller the required current. As a practical matter, the pin tip radius has an upper limit due to manufacturing restrictions. Conversely, the larger the diameter the more current is required for stable output. Thus, for a given plate current requirement and a given tip radius, there are two requirements that must be met which are total current to satisfy plate current requirements and individual pin current to ensure stable operation of the pins. When the individual pin current requirement for stable operation, for whatever reason, results in total current greater than that required for the plate the efficiency of the charging device decreases and ozone increases. In order to minimize the decrease in efficiency and increase in ozone, the pins 34 we supply them with sine wave or square wave pulsed d.c. power at a frequency in the range of 60–400 Hz by a circuit 94 illustrated in FIG. 2. The circuit 94 comprises an a.c. power source 96 and a pair of diodes 98 and 100.

Figure 2:
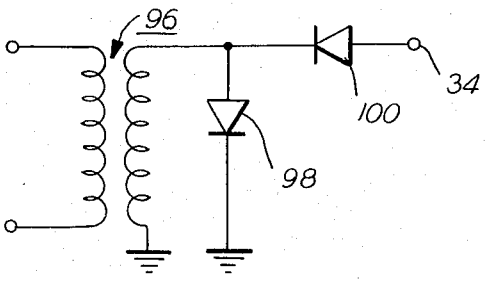
FIG. 2 illustrates a circuit for supplying current to the pin charging device incorporated in FIG. 1.
Figure 4:
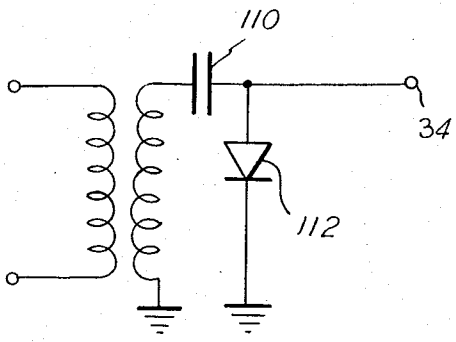
FIG. 4 illustrates a modified circuit for supplying current to the charging device incorporated in FIG. 3.

An alternate circuit as illustrated in FIG. 4 comprises a voltage doubler including a capacitor 110 and a diode 112 which produces higher peak current values for the same applied voltage as the circuit of FIG. 2.

Figure 3:
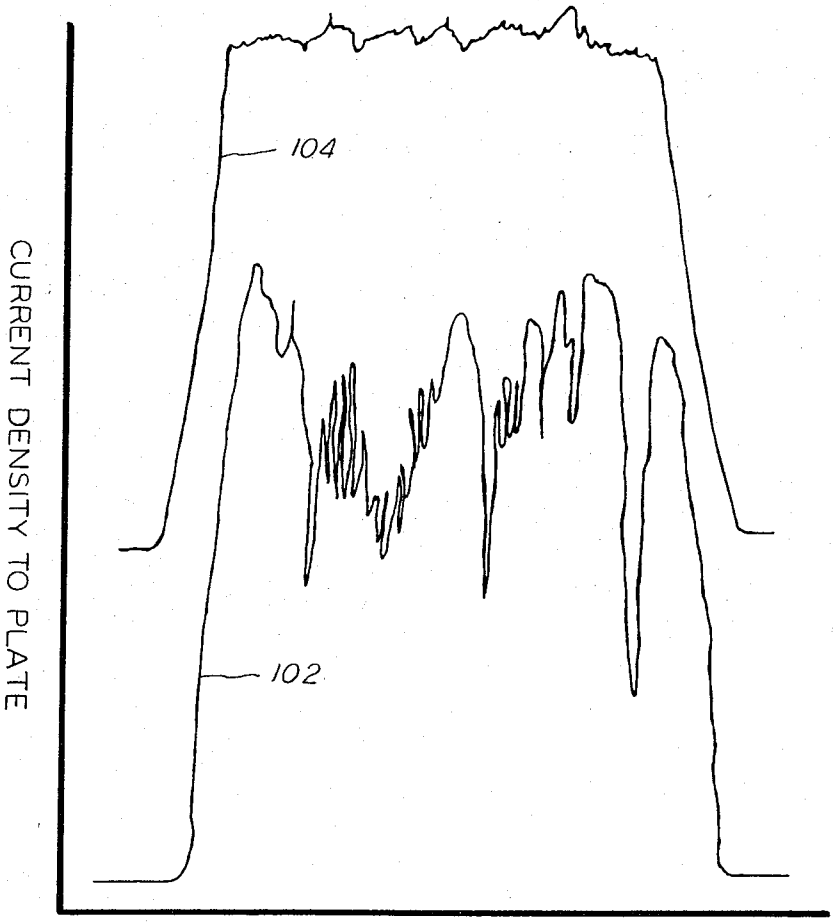
FIG. 3 illustrates two plates of current density to a plate vs. position along a linear pin array for a device powered by a conventional well filtered d.c. power supply and for a device powered by a sine wave pulsed d.c. at 4 KHz power supply.

With a conventional power supply such as a well-filtered d.c. supply the current output density from the pins 34 is represented in FIG. 3 by reference character 102. The output from pins 34 on the other hand using the circuit 94 is represented by reference character 104. As can be seen the output represented by reference character 104 is far more stable than that produced by the filtered d.c. power supply. By our arrangement for supplying current to the pins stability is achieved at low average current levels, therefore, our device is more efficient and generates less ozone. The waveform of the pulsing is not limited to sine wave. Square or "bulgy" sine waves may also be employed. Also, the charging device may be operated using a very high ripple. The high ripple will cause operation at high current densities but for shorter time intervals which because of the shorter time yields longer pin life.

We claim:

1. Charging apparatus for applying a uniform negative electrostatic charge to a charge retentive surface, said apparatus comprising:

an array of pin electrodes supported adjacent said surface in a non-contact relationship;

the end of each pin nearest said surface having radius small enough to provide uniform discharge with a predetermined current supplied thereto, said radius being less than 0.025 millimeter;

means for effecting relative movement between said pin electrodes and said charge retentive surface; and a power supply operatively coupled to said pin electrodes for supplying said predetermined current to each pin electrode, the magnitude of said current being sufficient to insure substantially uniform discharge therefrom over the life of said pin electrodes, said predetermined current to each pin electrode being at least four microamperes.

2. Apparatus according to claim 1 wherein said power supply is a pulsed d.c. supply.

3. Apparatus according to claim 2 wherein said pulsed d.c. power supply comprises a sine wave pulsed d.c. supply.

* * * * *